US007520779B2

(12) United States Patent
Arnaud et al.

(10) Patent No.: US 7,520,779 B2
(45) Date of Patent: Apr. 21, 2009

(54) 7-16 COAXIAL FLANGED RECEPTACLES

(75) Inventors: Pierre-Yves Arnaud, Sassenage (FR); Alain Guillomin, Entre Deux Guiers (FR); Claude Brocheton, Tullins (FR)

(73) Assignee: Radiall, Rosny-Sous-Bois (FR)

( * ) Notice: Subject to any disclaimer, the term of this patent is extended or adjusted under 35 U.S.C. 154(b) by 0 days.

(21) Appl. No.: 12/081,343

(22) Filed: Apr. 15, 2008

(65) Prior Publication Data

US 2008/0261446 A1 Oct. 23, 2008

(30) Foreign Application Priority Data

Apr. 17, 2007 (FR) ..... 07 54516

(51) Int. Cl.
*H01R 9/05* (2006.01)

(52) U.S. Cl. ..... 439/578

(58) Field of Classification Search ..... 439/583, 439/584, 578

See application file for complete search history.

(56) References Cited

U.S. PATENT DOCUMENTS 4,110,716 A * 8/1978 Nikitas ..... 439/583
4,593,464 A * 6/1986 Williams et al. ..... 439/675
4,662,703 A 5/1987 Forney, Jr. et al.
4,687,279 A * 8/1987 Holland et al. ..... 439/578
4,964,805 A * 10/1990 Gabany ..... 439/581
6,024,609 A * 2/2000 Kooiman et al. ..... 439/578
2002/0090860 A1 7/2002 Bohmer et al.
2004/0038587 A1 2/2004 Yeung et al.
2006/0258225 A1 11/2006 Hsu

FOREIGN PATENT DOCUMENTS

DE 20 08 409 A1 9/1971
DE 20 2006 007 028 U1 7/2006
EP 1 182 744 A2 2/2002

* cited by examiner

*Primary Examiner*—Briggitte R Hammond
(74) *Attorney, Agent, or Firm*—Oliff & Berridge, PLC

(57) ABSTRACT

A 7-16 flanged receptacle includes a tubular body including an outside thread and a fastener flange perpendicular to the longitudinal axis of the tubular body. A central contact is mounted in the tubular body with an insulator being interposed between the central contact and an outer contact. The receptacle further includes a tubular metal part forming the outer contact mounted as a tight fit in an inside wall of the tubular body with limited ability to move longitudinally relative thereto.

4 Claims, 2 Drawing Sheets

7-16 COAXIAL FLANGED RECEPTACLES

The present invention relates to 7-16 coaxial flanged receptacles.

BACKGROUND

Receptacles are referred to as 7-16 receptacles when they have an inside contact diameter of 7 millimeters (mm) and an outside contact diameter of 16 mm. 7-16 receptacles are in widespread use in telecommunications equipment for connecting radiofrequency lines for which there are very severe performance requirements in terms of losses and passive intermodulation.

In general, flanged receptacles are situated as inputs/outputs of duplexer filters, on antennas, and more generally on other pieces of equipment situated between those elements, such as mast amplifiers, lightning arrestors, etc.

To obtain as great as possible a reduction in the intermodulation phenomenon, it is conventional to use receptacles comprising a machined solid body presenting an outside thread and a fastener flange extending perpendicularly to the longitudinal axis of the body, the flange being substantially square in shape with four holes for passing mounting screws.

Those receptacles have the advantage of minimizing junction zones, which are sources of intermodulation, but the drawback of being expensive, heavy and difficult to mount. Mounting conventional receptacles by means of four screws engaged in the corresponding holes of the flange is difficult when it is desired to minimize intermodulation, because it is necessary to obtain a good distribution of pressures in the contact zones.

Proposals also have been made to replace the brass that is conventionally used with an alloy of lighter weight based on zinc (such as zinc alloys sold under the trademark ZAMAK) or aluminum.

The above-described problems remain substantially the same with this configuration, but the parts are less expensive to produce since the tubular bodies can be obtained by molding under pressure. The drawback is such that receptacles are difficult to protect and they are very sensitive to corrosion which requires the conductor to be subjected to surface treatment.

Proposals also have been made to provide 7-16 coaxial receptacles comprising a two-material tubular body, the flange being made of a plastics material that is overmolded or force-fitted on the tubular body that is made of brass.

That solution does not solve the problems associated with final assembly using screws engaged in the holes of the flange.

Furthermore, it is found that large amounts of deformation in use under stress continue because of a relaxation phenomenon that causes contact pressures to decrease over time.

SUMMARY

The present invention seeks to provide a 7-16 coaxial flanged receptacle that is very easy to mount, that enables excellent intermodulation performance to be obtained, that is light in weight, that presents good corrosion resistance, and that has a low fabrication cost.

According to one aspect of the invention, there is provided a 7-16 flanged receptacle comprising a tubular body including an outside thread and a fastener flange perpendicular to a longitudinal axis of the tubular body, a central contact mounted in the tubular body, an insulator interposed between the central contact and an outer contact, a tubular metal part forming the outer contact mounted as a tight fit in an inside wall of the tubular body with limited ability to move longitudinally relative thereto.

The term "limited ability to move longitudinally" is used herein to mean a movement of 0.05 mm to 1 mm depending on the axial force applied during the mounting of the receptacle on a piece of equipment or when tightening a plug on the receptacle.

The central contact and the metal tubular part forming the outer contact are preferably both made of brass.

Preferably, the body is a single part of molded plastics material.

The tubular body is advantageously made of an injected-molded plastics material, selected from the group comprising: polyaryl-amides (PAAs), polyamide-imides (PAIs), and polyphenylene sulfides (PPSs), preferably filled with fibers made of glass, or of carbon, or of an optionally conductive metal material.

According to some aspects of the invention, the tubular body may be made of metal, e.g., an alloy of zinc or aluminum, that has been subjected to anti-corrosion surface treatment, in particular chrome passivation.

According to some aspects of the invention, the tubular metal part forming the outer contact is held in the body, prior to the receptacle being put into place on a piece of equipment, preferably by a small amount of clamping or by clip-fastening or by deformation of the facing inside wall of the tubular body.

BRIEF DESCRIPTION OF THE DRAWINGS

Other advantages and characteristics appear on reading the following descriptions of non-limiting, exemplary embodiments given with reference to the accompanying drawings, in which.

DETAILED DESCRIPTION

Figure 1:
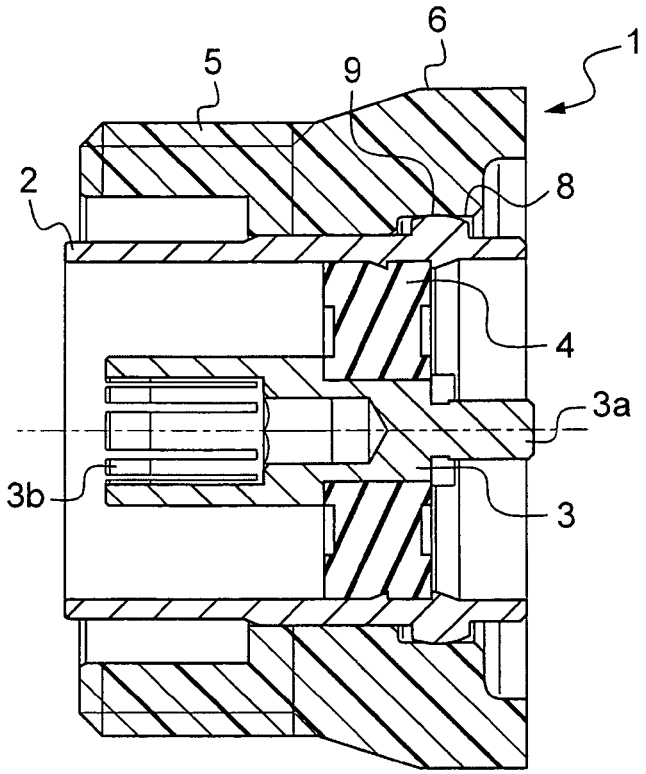
FIG. 1 is a section view of the flanged receptacle according to an embodiment of the invention.
Figure 2:
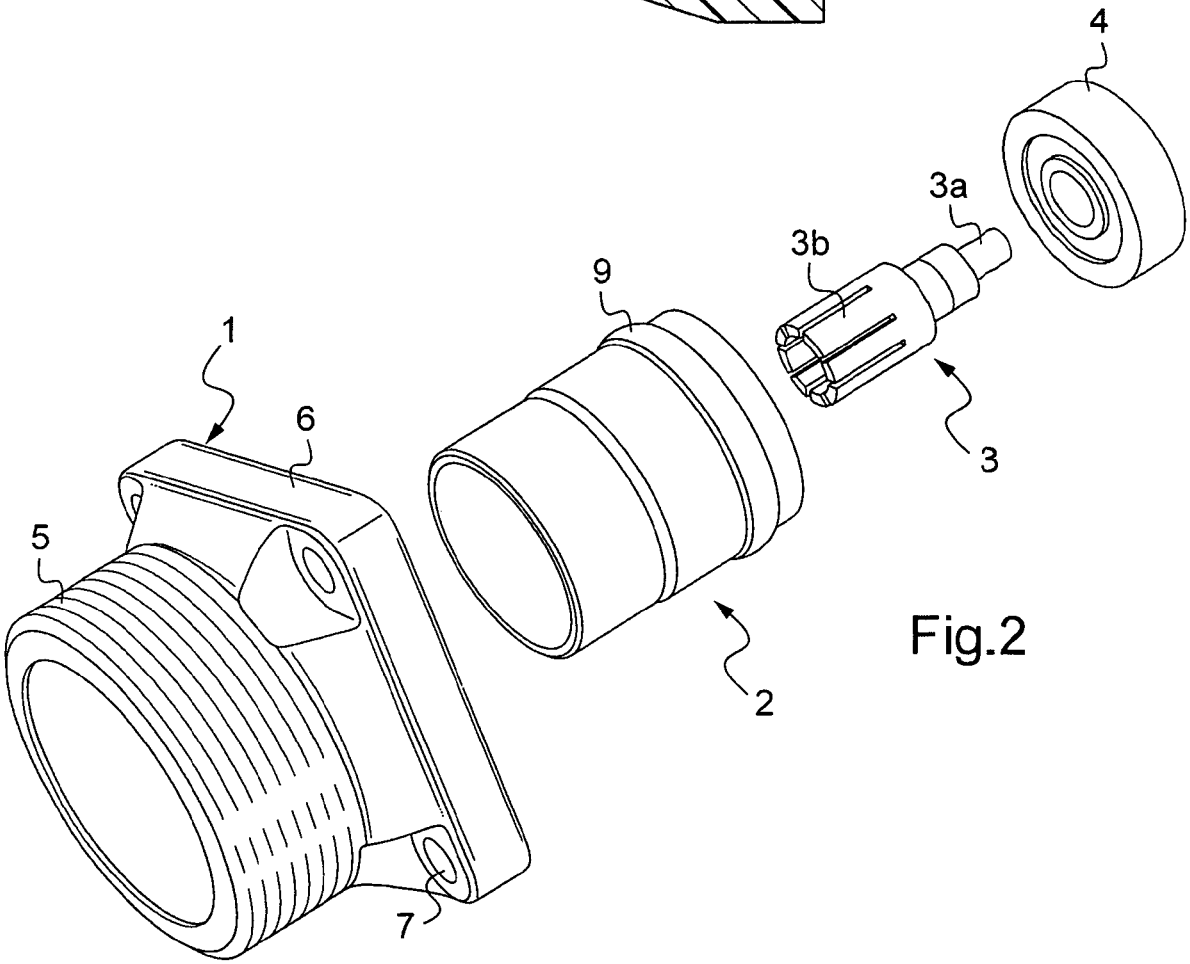
FIG. 2 is an exploded perspective view of the components of the receptacle shown in FIG. 1.
Figure 3:
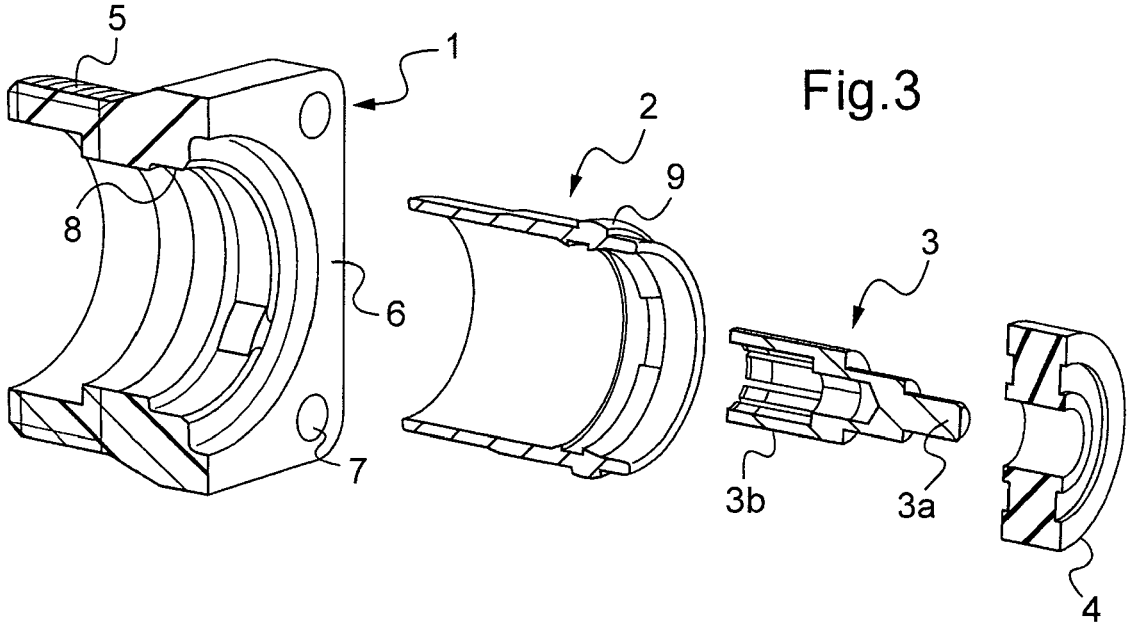
FIG. 3 is an exploded section view in half-section showing the components of the receptacle of an embodiment of the invention.
Figure 4:
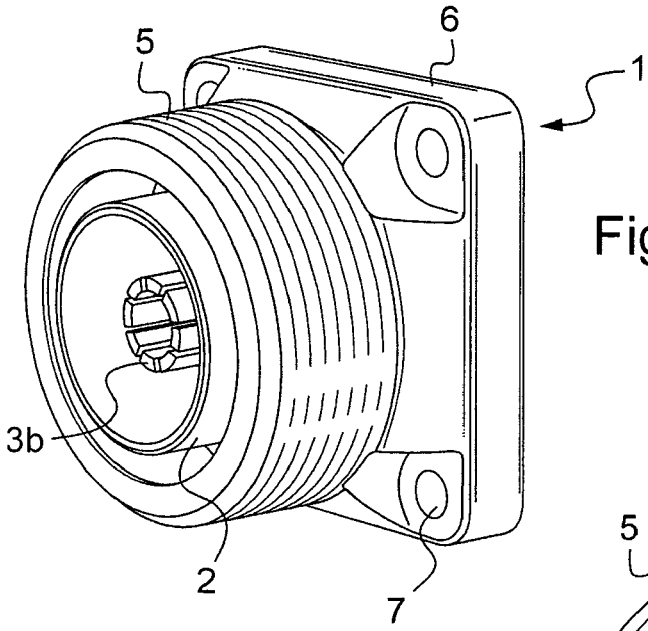
FIGS. 4 and 5 show the receptacle seen from two different angles.
Figure 5:
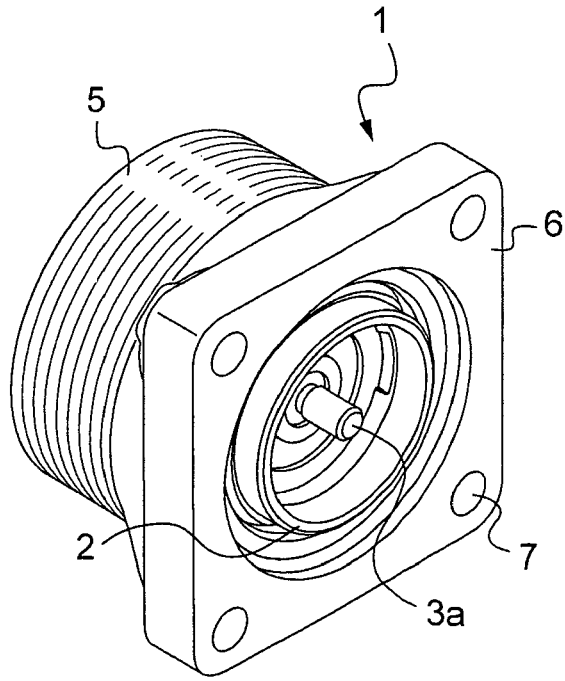

The flanged receptacle shown in the drawings comprises a tubular body given overall reference 1, a tubular metal part made of brass given overall reference 2 received inside the tubular body and forming an outer, ground contact, a central brass contact 3 having a male contact end 3*a* and a female contact end 3*b*, and insulation 4 interposed between the central contact 3 and the outer ground contact 2.

The tubular body 1 includes an outside thread 5 and a flange 6 in the form of a square with rounded corners provided in its four corners with holes 7 for passing mounting screws (not shown).

In its inside wall, the tubular body 1 includes a set-back bearing surface 8 that receives bearing thereagainst an annular bead 9 of the part 2 forming the outer ground contact 2.

The tubular body 1 of the receptacle is made by injection molding PAA.

In another embodiment, it is possible to use PAI or PPS as the plastics material.

The plastics material used presents a high degree of rigidity, a low degree of creep, and a coefficient of thermal expansion that is close to that of brass.

The interference between the bead 9 on the part forming the outer ground contact 2 and the set-back bearing surface 8 of the tubular body 1 enables the components of the receptacle to stay held together prior to being mounted on equipment. A small amount of sliding of the part forming the outer ground contact 2 might occur during mounting of the receptacle under the action of the applied tightening force, or when tightening a plug on the receptacle, and the intermodulation characteristics are unmodified in the event of incorrect mounting.

Although the invention has been described with reference to particular embodiments, it is to be understood that these embodiments are merely illustrative of principles and applications of the invention. It is therefore to be understood that numerous modifications may be made to the illustrative embodiments and that other arrangements may be devised without departing from the spirit and scope of the invention.

What is claimed is:

1. A 7-16 flanged receptacle comprising:

a tubular body including an outside thread and a fastener flange perpendicular to a longitudinal axis of the tubular body;

a central contact mounted in the tubular body;

a tubular metal part forming an outer contact mounted as a tight fit in an inside wall of the tubular body with limited ability to move longitudinally relative to the tubular body; and an insulator interposed between the central contact and the outer contact, wherein the outer contact includes on an outside surface a peripheral bead that is engaged within a bearing surface set back in the inside wall of the tubular body.

2. A receptacle according to claim 1, wherein the tubular body is a single piece of molded plastics material.

3. A receptacle according to claim 2, wherein the tubular body is an injection molded tubular body.

4. A receptacle according to claim 2, wherein the plastics material is selected from at least one of polyaryl-amides, polyamide-imides and polyphenylene sulfides.

* * * * *